US012366066B2

(12) United States Patent
Lahita

(10) Patent No.: US 12,366,066 B2
(45) Date of Patent: Jul. 22, 2025

(54) RADIO FREQUENCY AND ACOUSTIC MITIGATING CEILING TILE SYSTEM

(71) Applicant: Shielding Resources Group, Inc., Tulsa, OK (US)

(72) Inventor: Michael John Lahita, Owasso, OK (US)

(73) Assignee: Shielding Resources Group, Inc., Tulsa, OK (US)

( * ) Notice: Subject to any disclaimer, the term of this patent is extended or adjusted under 35 U.S.C. 154(b) by 226 days.

(21) Appl. No.: 18/100,166

(22) Filed: Jan. 23, 2023

(65) Prior Publication Data

US 2024/0141644 A1 May 2, 2024

Related U.S. Application Data

(60) Provisional application No. 63/301,605, filed on Jan. 21, 2022.

(51) Int. Cl.

| | |
|---|---|
| ***E04B 9/00*** | (2006.01) |
| ***E04B 1/92*** | (2006.01) |
| ***E04B 9/04*** | (2006.01) |
| ***E04B 9/06*** | (2006.01) |
| ***E04B 9/24*** | (2006.01) |
| ***E04B 9/30*** | (2006.01) |

(52) U.S. Cl.

CPC ..... *E04B 9/001* (2013.01); *E04B 1/92* (2013.01); *E04B 9/045* (2013.01); *E04B 9/06* (2013.01); *E04B 9/241* (2013.01); *E04B 9/30* (2013.01)

(58) Field of Classification Search

CPC . E04B 9/00; E04B 9/001; E04B 9/008; E04B 1/88; E04B 1/92; E04B 1/941; E04B 1/99; E04B 9/045; E04B 9/06; E04B 9/241; E04B 9/18; E04B 9/30

See application file for complete search history.

(56) References Cited

U.S. PATENT DOCUMENTS

| | | | | |
|---|---|---|---|---|
| 3,599,921 | A * | 8/1971 | Cumber | E04B 9/006 248/300 |
| 3,745,226 | A | 7/1973 | Nichols et al. | |
| 4,794,206 | A | 12/1988 | Weinstein | |
| 5,276,277 | A | 1/1994 | Hightower et al. | |
| 6,389,771 | B1 * | 5/2002 | Moller | E04B 9/28 52/715 |
| 7,246,681 | B2 | 7/2007 | Christen | |
| 8,029,881 | B2 | 10/2011 | Surace et al. | |
| 9,238,912 | B1 * | 1/2016 | Pham | E04B 1/8409 |
| 9,828,798 | B1 | 11/2017 | Lahita | |
| 9,845,596 | B2 * | 12/2017 | Frantz | E04B 9/0457 |
| 9,930,816 | B2 | 3/2018 | Winch et al. | |
| 10,196,816 | B2 * | 2/2019 | Bergman | E04B 9/04 |
| 11,028,581 | B2 * | 6/2021 | Masia | E04B 9/04 |
| 11,459,752 | B2 * | 10/2022 | Oleske | E04B 9/001 |

(Continued)

FOREIGN PATENT DOCUMENTS

| | | |
|---|---|---|
| GB | 2234636 | 2/1991 |
| JP | 2019088470 | 6/2019 |

*Primary Examiner* — Chi Q Nguyen

(74) *Attorney, Agent, or Firm* — Head, Johnson, Kachigian & Wilkinson, PC

(57) ABSTRACT

A ceiling tile system capable of mitigating radio-frequency and acoustic waves from passing therethrough including a set of conductive grid bars; and a set of ceiling tiles each having a layer of conductive material and a layer of acoustic insulation.

18 Claims, 9 Drawing Sheets

(56) References Cited

U.S. PATENT DOCUMENTS

| | | | | |
|---|---|---|---|---|
| 11,536,024 | B2 * | 12/2022 | Pham | B32B 5/26 |
| 12,017,441 | B2 * | 6/2024 | Pham | C04B 26/28 |
| 2004/0016184 | A1 * | 1/2004 | Huebsch | E04B 9/001 52/506.07 |
| 2014/0008119 | A1 | 1/2014 | Brandt | |
| 2018/0142849 | A1 * | 5/2018 | Nicolai | F21V 29/70 |
| 2019/0029147 | A1 | 1/2019 | Cordes | |
| 2020/0029474 | A1 | 1/2020 | Hawn | |
| 2021/0291492 | A1 * | 9/2021 | Lanciaux | E04B 9/045 |
| 2021/0301525 | A1 * | 9/2021 | Baxter | E04B 9/06 |

* cited by examiner

RADIO FREQUENCY AND ACOUSTIC MITIGATING CEILING TILE SYSTEM

CROSS-REFERENCE

This application is based on and claims priority to U.S. Provisional Patent Application Ser. No. 63/301,605, filed Jan. 21, 2022, which is incorporated herein in its entirety by reference.

BACKGROUND OF THE INVENTION

1. Field of the Invention

The present invention is directed to a dropped ceiling tile system capable of mitigating or eliminating radio frequency (RF) and acoustic transmissions therethrough.

2. Description of the Related Art

Dropped ceiling tile systems are a common choice for the ceilings of offices, laboratories, retail establishments, and many other types of commercial buildings. Dropped tile ceilings are affordable and easily configurable. Further, the space above the ceiling system may house duct work, electrical wiring, fire-suppression systems, etc. If any of the equipment located above the ceiling must be repaired or modified, the tiles of the ceiling may easily be removed during repairs or modifications and then replaced when the work is done. Lastly, due to the modular nature of a dropped ceiling tile system, if part of the ceiling is damaged, then the damaged tiles can be removed and replaced without replacing the entire ceiling.

Where electronic and audible privacy is a concern such as in military, defense, government, embassy, and technical installations, it is preferable that a dropped ceiling tile system may be utilized while maintaining a high level of electronic and audible privacy.

It would therefore be desirable to provide a traditional dropped ceiling tile system with radio frequency mitigation capabilities.

It would also be desirable to provide a dropped ceiling tile system capable of mitigating the transmission of both radio frequency and acoustic waves through the ceiling.

It would also be desirable to provide such a dropped ceiling tile system without compromising the impermanent, modular, and replaceable qualities of traditional dropped ceiling tile systems.

It would also be desirable to provide a dropped ceiling tile system which can be installed by retrofitting a traditional ceiling tile system.

SUMMARY OF THE INVENTION

The present invention is directed to a ceiling tile system adapted to mitigate radio-frequency and acoustic waves from passing therethrough comprising: a set of conductive grid bars; and a set of ceiling tiles each having a layer of conductive material and a layer of acoustic insulation.

The conductive grid bars and the layer of conductive material of each ceiling tile may be conductively connected. Further, a conductive connecting mechanism may facilitate a reliable conductive connection between the conductive grid bars and the layer of conductive material of each ceiling tile. The conductive connecting mechanism may comprise a strip of foam wrapped in a conductive fabric or conductive foil. Alternatively, the conductive connecting mechanism may comprise a conductive contact strip such as fingerstock.

The ceiling tile system may further comprise conductive wall angles such that the ceiling tile system may be conductively connected to a conductive layer of an adjacent wall.

The ceiling tile system may further comprise a set of hold-down clips mounted on the top bulb of the conductive grid bars to firmly hold each of the ceiling tiles against the conductive grid bars.

The layer of conductive material in each ceiling tile may be exposed only along an outer edge of a bottom face of the ceiling tile.

The ceiling tile system may further comprise a set of hanger wires to support said ceiling tile system.

The ceiling tile system may further comprise a layer of mineral wool either positioned above each ceiling tile or incorporated therein.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
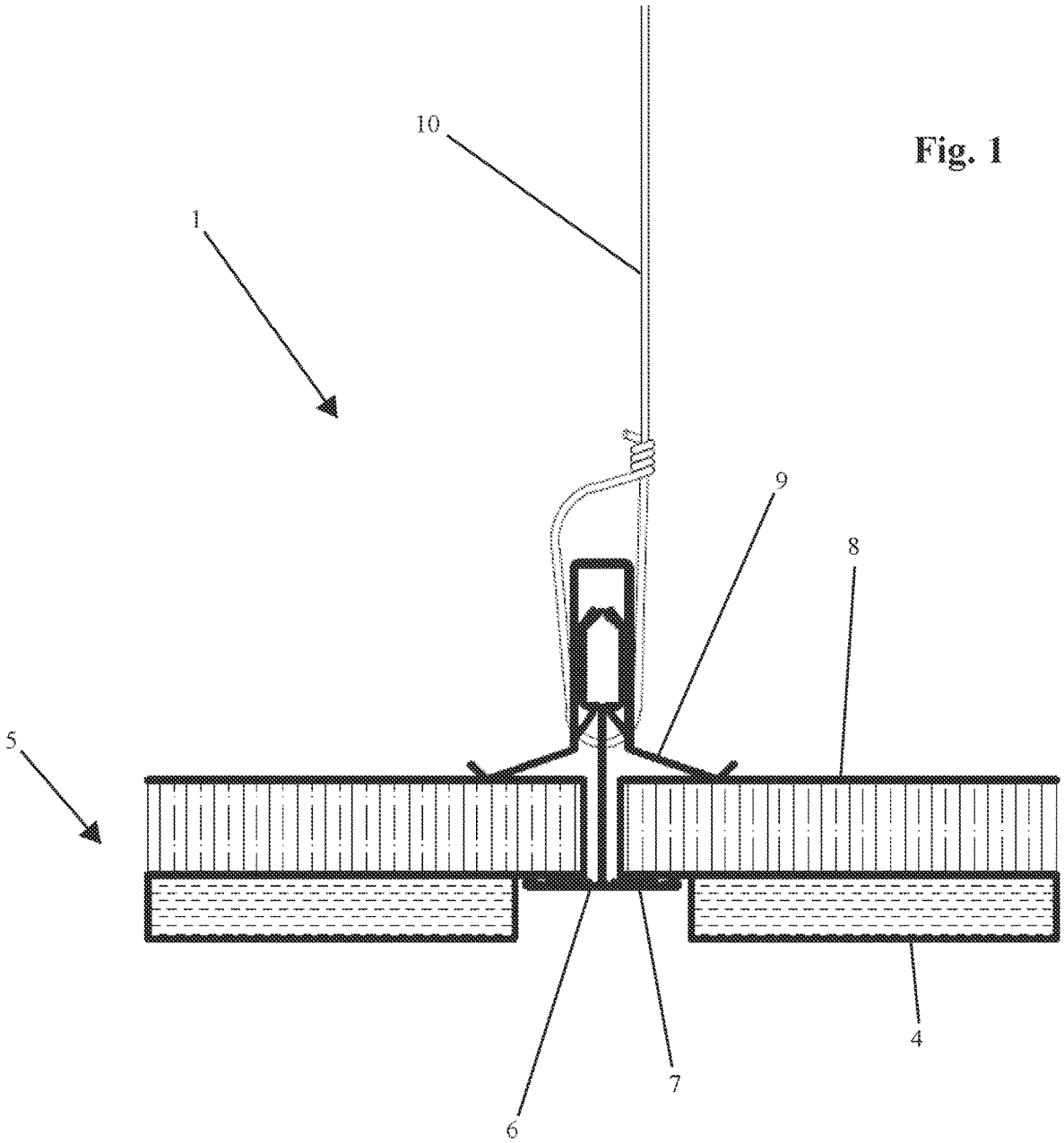
FIG. 1 illustrates a cross-sectional view of a portion of one embodiment of a radio frequency and acoustic mitigating ceiling tile system according to the present invention.
Figure 2:
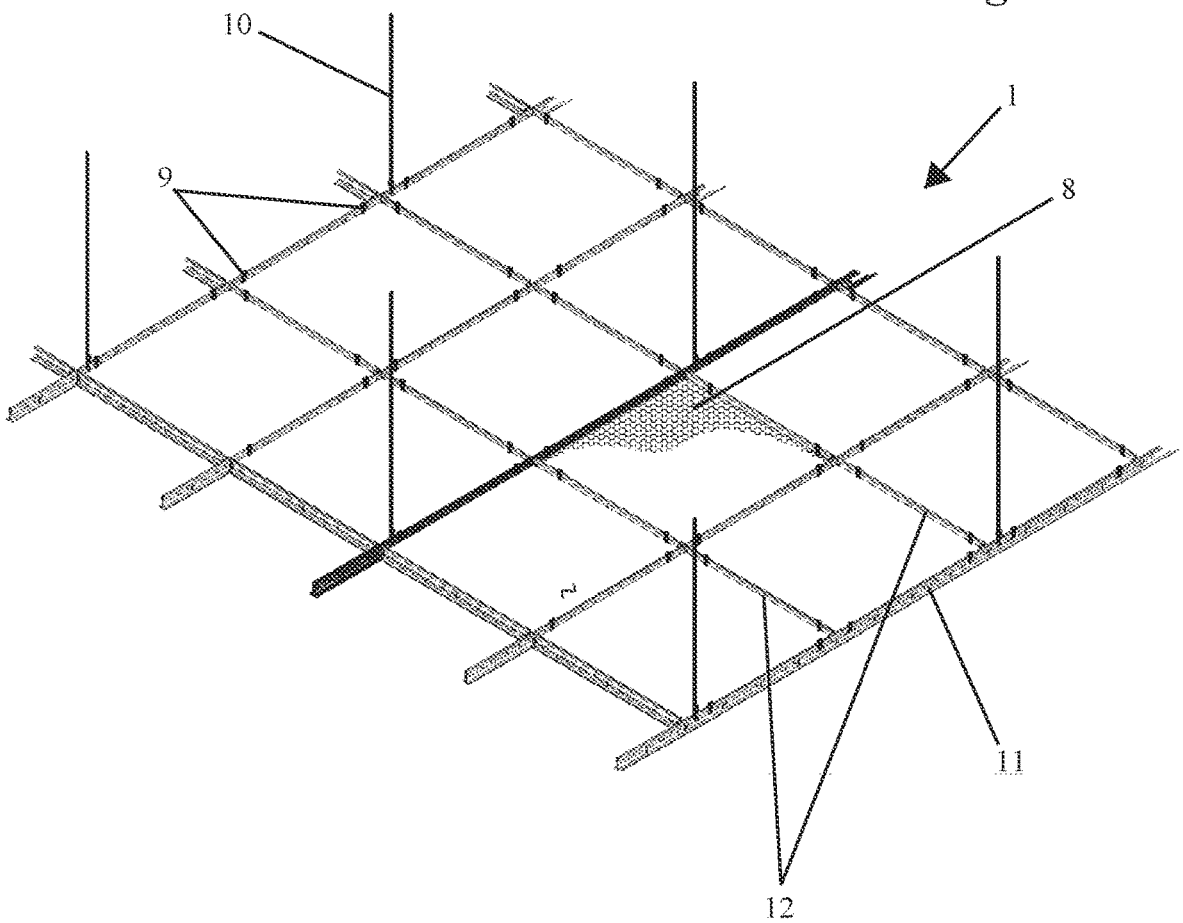
FIG. 2 illustrates a perspective view of an entire dropped ceiling tile system as shown in FIG. 1.

Referring to the drawings in detail, FIG. 1 illustrates a sectional view of a portion of an assembled dropped ceiling tile system 1 according to one embodiment of the present invention. FIG. 2 illustrates a perspective view of an entire dropped ceiling tile system 1 according to the embodiment shown in FIG. 1.

The dropped ceiling tile system 1 capable of mitigating the transmission of radio frequency and acoustic waves therethrough may include conductive grid bars 6, conductive wall angle bars 14, conductive ceiling tile panels 5, and a conductive connecting mechanism 7 located between the grid bars and the ceiling panels.

The conductive grid bars 6 may be composed of typical commercially available drop ceiling grid bars. The grid bars may be all uniform. Alternatively, the grid bars may consist of main beams 11 running in parallel along the length of a room and a series of cross tees 12 creating a grid between the main beams for placing tiles 5. The grid bars may be constructed with a conductive material which is at least exposed on the upward facing surface upon which the ceiling panels rest.

The conductive connecting mechanism 7 may be composed of a thin strip of foam wrapped in a conductive fabric or a conductive contact strip such as fingerstock 16. The fingerstock 16 may be plated in tin or any other suitable material. The gasket may be attached to and span the entirety of the upward facing surface of the grid bars upon which the ceiling panels typically rest. The purpose of the gasket is to ensure a reliable conductive contact at all points between the grid bars 6 and the ceiling panels 5. Further, hold-down clips 9 may be employed on the grid bars 6 to hold down the bottom surface of the ceiling panels 5 in contact with the conductive connecting mechanism 7.

The wall angle bars 14 may be composed of the typical commercially available drop ceiling wall edge bars. The wall angle bars 14 are commonly constructed using a conductive material. The upward facing surface of the lip upon which the ceiling panels rest may be an exposed conductive surface which will ensure a reliable conductive connection between the wall angle and the conductive gasket. If the surface of the wall angle bar that comes into contact with the wall is coated in a non-conductive material, the non-conductive coating is removed to ensure a reliable conductive connection between the wall angle bar and the surface of the wall. Even further, conductive tape can be installed over the top seam of the wall angle and the surface of the wall to ensure no non-conductive gap exists at any point along the seam.

At least the exposed, or downward facing, surface of the ceiling panels 5 may be composed entirely of a conductive material. The surface may, however, be coated with a non-conductive material so long as the outer edges of the surface which rest atop the conductive gasket are conductive. Exposing the conductive material at the outer edges of surface ensures a reliable conductive connection between the outer edges of the lower face of the ceiling tile and the conductive connecting mechanism.

When installed, the ceiling tile system 1 may constitute a unified conductive surface which shields the entire ceiling from radio frequency wave penetration. Further, the system may allow for conductive contact with the surface of the walls along the entire perimeter of the ceiling system. When installed with RF shielded walls, ceilings, and doors, a room with complete RF shielding from outside waves can be attained.

Alternatively, the ceiling tiles may not have an uninterrupted conductive material therethrough or thereon such that the ceiling acts as a waveguide and merely mitigates that transmission of radio frequency waves instead of eliminating their transmission altogether.

Previous attempts at creating an RF shielding drop ceiling system include use of conductive spray-paint, use of a conductive caulk, and cardboard covered in foil used as ceiling tiles. The first attempt merely consists of coating the entire upper surface of a drop ceiling with conductive spray-paint. This first alternative system does not provide a consistent enough layer of conductive material to ensure radio frequency shielding. The second attempt consisted of placing conductive caulk between the ceiling tiles and the ceiling tile grid bars to ensure a seamless conductive connection. Neither alternative system allows for subsequent physical access through the ceiling tile system because the ceiling tiles are permanently affixed to the ceiling tile grid bars. Further, silicone based conductive caulking is commonly banned from use in electronic testing laboratories where these drop ceiling systems would typically be installed.

One benefit of the presently disclosed invention over the prior art is a more reliable conductive connection at every junction and seam in the system. Another benefit of the presently disclosed invention is the ability to access above the drop ceiling for repairing wiring or any other purpose by easily removing and replacing ceiling tiles. Finally, another benefit to the presently disclosed system is the ability to retrofit previously installed ceiling tile systems to be RF shielded.

Lastly, the tiles may be acoustically insulated to prevent acoustic waves from transmitting through the ceiling or to mitigate acoustic waves from transmitting through the ceiling. The acoustic insulation 4 may be on either the top or bottom layers of the ceiling tile 5 or may be embedded therein.

The embodiment of the present invention shown in FIGS. 1 and 2 comprises dual faced RF honeycomb waveguide panels 8 with decorative acoustic ceiling tiles 4 mounted on the bottom face.

Figure 3:
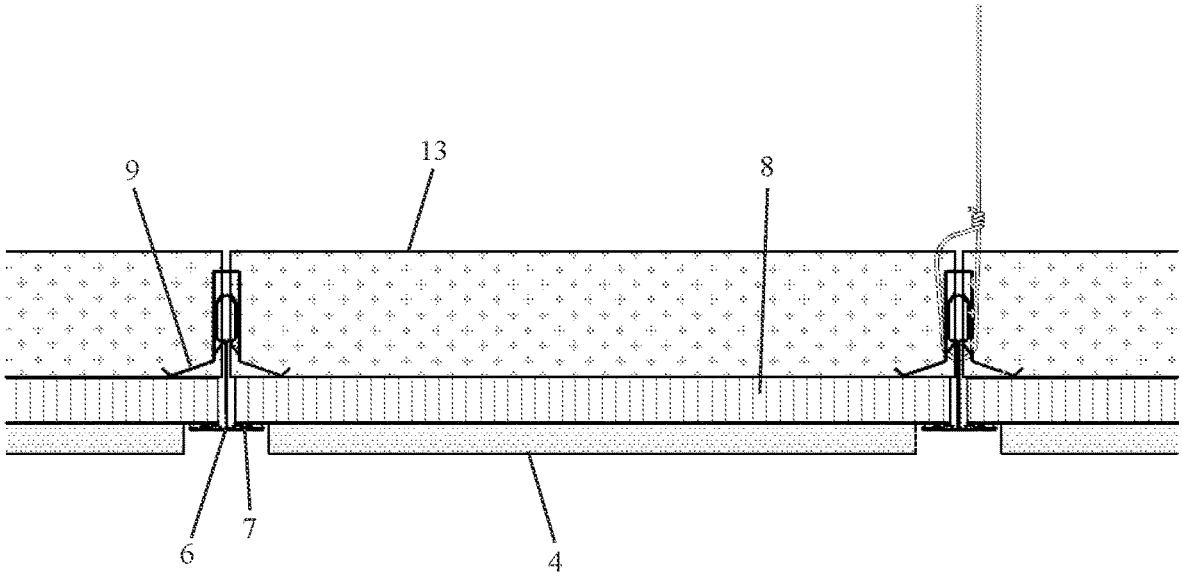
FIG. 3 illustrates a cross-sectional view of a portion of a second embodiment of a radio frequency and acoustic mitigating ceiling tile system according to the present invention.
Figure 4:
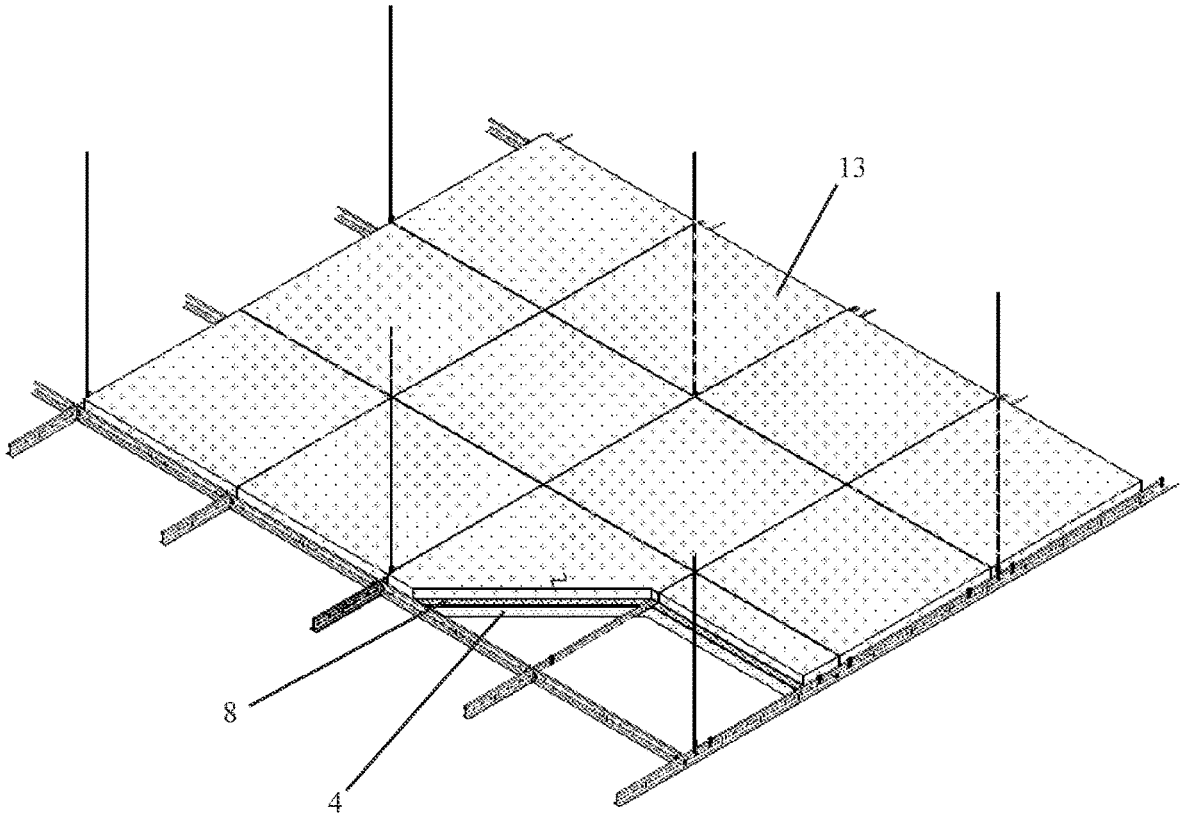
FIG. 4 illustrates a perspective view of an entire dropped ceiling tile system as shown in FIG. 3.

The embodiment of the present invention shown in FIGS. 3 and 4 further comprises a layer of mineral wool 13 on top of the ceiling tiles 5 to act as additional acoustic insulation.

Figure 5:
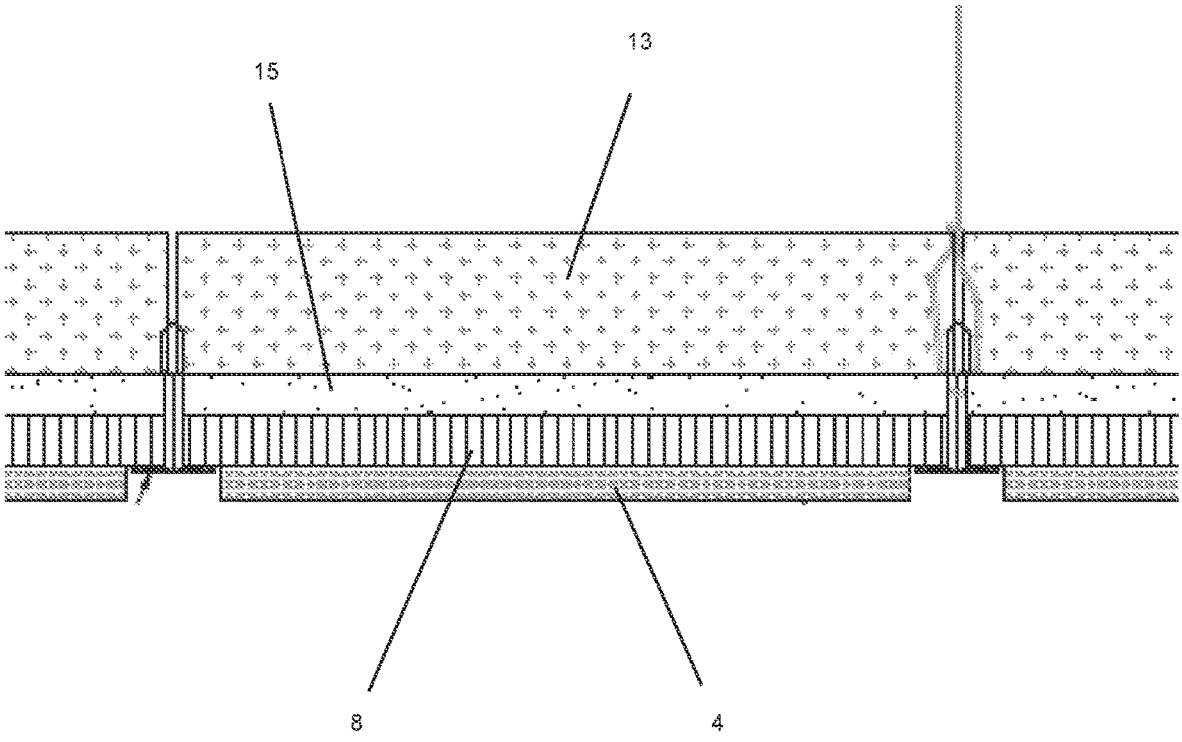
FIG. 5 illustrates a cross-sectional view of a portion of a third embodiment of a radio frequency and acoustic mitigating ceiling tile system according to the present invention.
Figure 6:
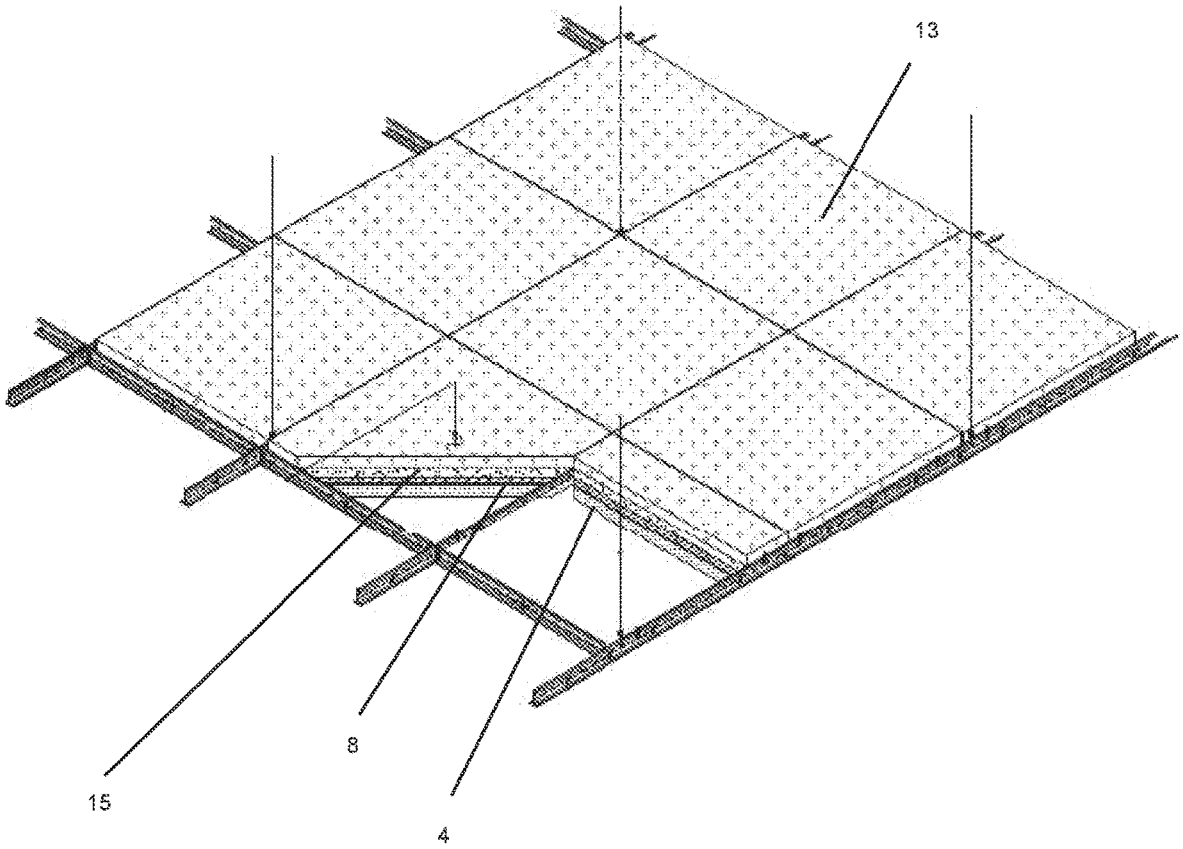
FIG. 6 illustrates a perspective view of an entire dropped ceiling tile system as shown in FIG. 5.
Figure 7:
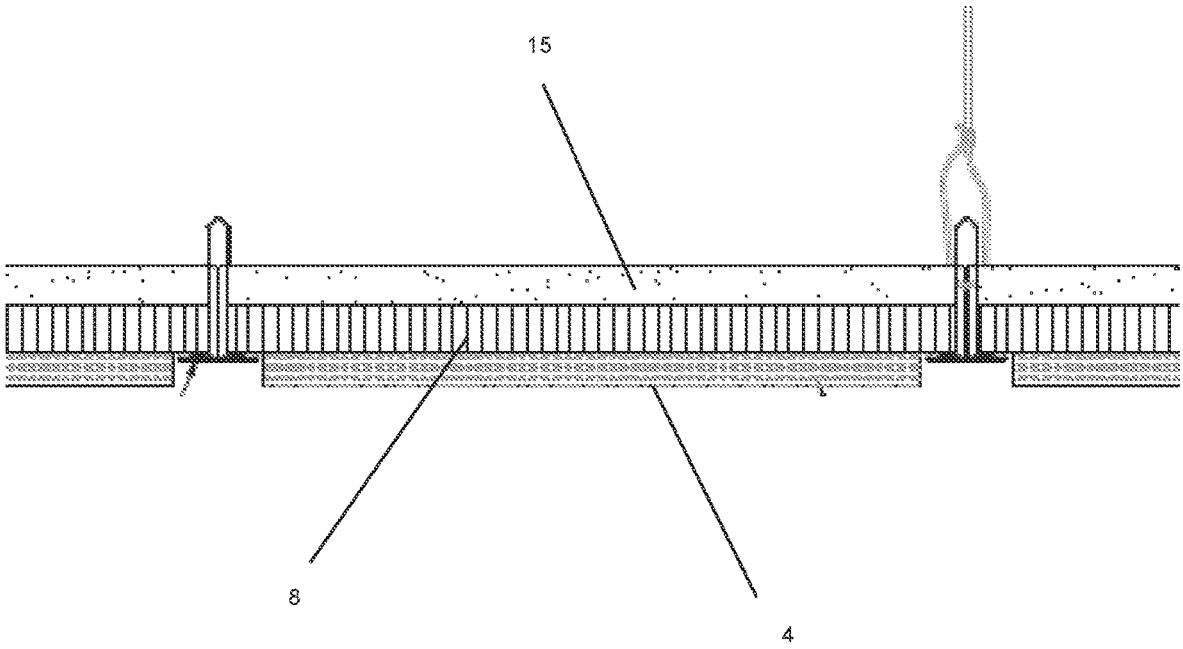
FIG. 7 illustrates a cross-sectional view of a portion of a fourth embodiment of a radio frequency and acoustic mitigating ceiling tile system according to the present invention.
Figure 8:
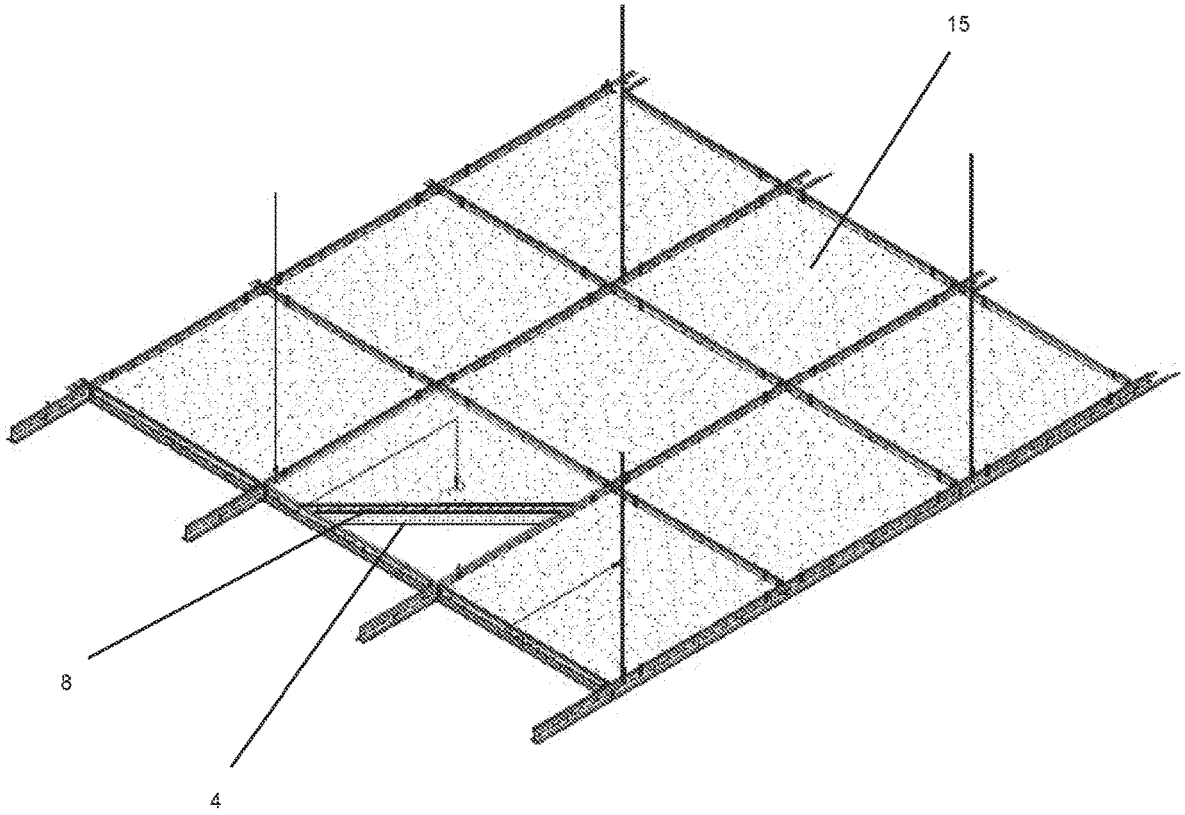
FIG. 8 illustrates a perspective view of an entire dropped ceiling tile system as shown in FIG. 7.
Figure 9:
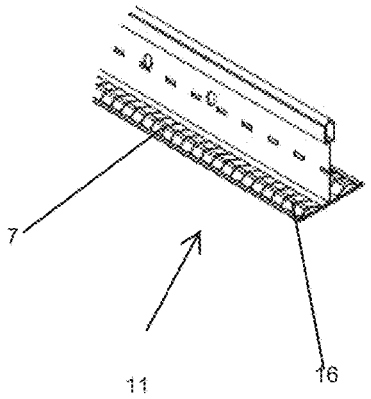
FIG. 9 illustrates a perspective view of a portion of a main beam.
Figure 10:
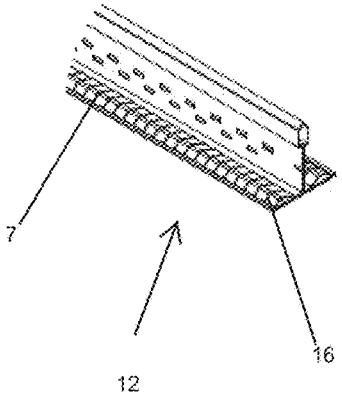
FIG. 10 illustrates a perspective view of a portion of a cross tee.
Figure 11:
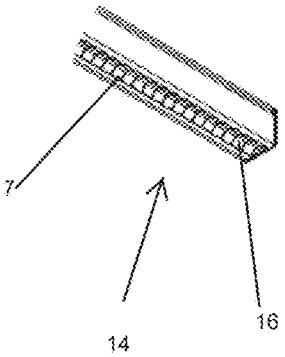
FIG. 11 illustrates a perspective view of a portion of a wall angle.

The embodiment of the present invention shown in FIGS. 5 and 6 further comprises a layer of gypsum board 15 between the mineral wool 13 and the dual faced RF honeycomb waveguide panels 8. The embodiment of the present invention shown in FIGS. 7 and 8 further comprises a layer of gypsum board 15 atop the dual face RF panels 8, without the mineral wool 13. In both embodiments, the gypsum board 15 may allow the panels to be tuned for various sound transmission class levels.

The dual faced RF panels 8 may alternately each be a single faced panel or a single sheet of conductive material.

Whereas, the invention has been described in relation to the drawings attached hereto, it should be understood that other and further modifications, apart from those shown or suggested herein, may be made within the scope of this invention.

What is claimed is:

1. A ceiling tile system capable of mitigating radio-frequency and acoustic waves from passing therethrough, said ceiling tile system comprising:

a plurality of conductive grid bars;

a plurality of ceiling tiles each having a layer of conductive material and a layer of acoustic insulation; and a conductive connecting mechanism;

wherein the conductive connecting mechanism comprises a strip of foam wrapped in a conductive fabric or conductive foil and facilitates a reliable conductive connection between the plurality of conductive grid bars and the layer of conductive material of each of said plurality of ceiling tiles.

2. The ceiling tile system of claim 1 further comprising conductive wall angles such that the ceiling tile system is capable of being conductively connected to a conductive layer of an adjacent wall.

3. The ceiling tile system of claim 1 further comprising hold-down clips mounted on the plurality of conductive grid bars to firmly hold each of the ceiling tiles against the conductive grid bars.

4. The ceiling tile system of claim 1 wherein the layer of conductive material in each ceiling tile is exposed only along an outer edge of a bottom face of the ceiling tile.

5. The ceiling tile system of claim 1 further comprising a set of hanger wires to support said ceiling tile system.

6. The ceiling tile system of claim 1 further comprising a layer of mineral wool positioned above each ceiling tile.

7. The ceiling tile system of claim 6 wherein each ceiling tile further comprises a layer of gypsum board between the layer of conductive material and the layer of mineral wool.

8. The ceiling tile system of claim 1 wherein each ceiling tile further comprises a layer of mineral wool therein.

9. The ceiling tile system of claim 1 further comprising a layer of gypsum board above each ceiling tile.

10. A ceiling tile system capable of mitigating radio-frequency and acoustic waves from passing therethrough, said ceiling tile system comprising:

a plurality of conductive grid bars;

a plurality of ceiling tiles each having a layer of conductive material and a layer of acoustic insulation; and a conductive connecting mechanism;

wherein the conductive connecting mechanism comprises a conductive contact fingerstock strip disposed on an upward-facing surface of the conductive grid bars and facilitates a reliable conductive connection between the plurality of conductive grid bars and the layer of conductive material of each of said plurality of ceiling tiles.

11. The ceiling tile system of claim 10 further comprising conductive wall angles such that the ceiling tile system is capable of being conductively connected to a conductive layer of an adjacent wall.

12. The ceiling tile system of claim 10 further comprising hold-down clips mounted on the plurality of conductive grid bars to firmly hold each of the ceiling tiles against the conductive grid bars.

13. The ceiling tile system of claim 10 wherein the layer of conductive material in each ceiling tile is exposed only along an outer edge of a bottom face of the ceiling tile.

14. The ceiling tile system of claim 10 further comprising a set of hanger wires to support said ceiling tile system.

15. The ceiling tile system of claim 10 further comprising a layer of mineral wool positioned above each ceiling tile.

16. The ceiling tile system of claim 15 wherein each ceiling tile further comprises a layer of gypsum board between the layer of conductive material and the layer of mineral wool.

17. The ceiling tile system of claim 10 wherein each ceiling tile further comprises a layer of mineral wool therein.

18. The ceiling tile system of claim 10 further comprising a layer of gypsum board above each ceiling tile.

* * * * *